US009506293B2

(12) United States Patent
Beachy

(10) Patent No.: US 9,506,293 B2
(45) Date of Patent: Nov. 29, 2016

(54) PAINT ROLLER TRAY MOUNTING DEVICE

(71) Applicant: Marvin E. Beachy, Gransville, MD (US)

(72) Inventor: Marvin E. Beachy, Gransville, MD (US)

( * ) Notice: Subject to any disclaimer, the term of this patent is extended or adjusted under 35 U.S.C. 154(b) by 0 days.

(21) Appl. No.: 14/986,704

(22) Filed: Jan. 3, 2016

(65) Prior Publication Data

US 2016/0115736 A1 Apr. 28, 2016

Related U.S. Application Data

(60) Division of application No. 14/677,723, filed on Apr. 2, 2015, now Pat. No. 9,255,445, which is a continuation of application No. 12/774,691, filed on May 5, 2010, now abandoned.

(51) Int. Cl.

| | |
|---|---|
| ***E06C 7/14*** | (2006.01) |
| ***B44D 3/12*** | (2006.01) |
| ***E06C 7/16*** | (2006.01) |

(52) U.S. Cl.

CPC ..... *E06C 7/14* (2013.01); *B44D 3/126* (2013.01); *E06C 7/16* (2013.01); *Y10T 29/49826* (2015.01); *Y10T 29/49948* (2015.01)

(58) Field of Classification Search

CPC ..... E06C 7/14; B44D 3/126

See application file for complete search history.

(56) References Cited

U.S. PATENT DOCUMENTS

| | | | | |
|---|---|---|---|---|
| 2,444,096 | A * | 6/1948 | Faust | B44D 3/126 15/257.06 |
| 2,473,951 | A | 6/1949 | Hickey | |
| 2,641,382 | A | 6/1953 | Flay | |
| 3,495,683 | A | 2/1970 | Broden | |
| 3,580,440 | A | 5/1971 | Fry | |
| 3,822,846 | A | 7/1974 | Jesionowski | |
| 4,424,949 | A | 1/1984 | Kimmett | |
| 4,489,911 | A | 12/1984 | Riley | |
| 4,533,018 | A | 8/1985 | Tyson | |
| 4,760,000 | A | 7/1988 | Williams | |
| 5,098,052 | A | 3/1992 | Beck | |
| 5,132,194 | A | 7/1992 | Williams | |
| 5,135,193 | A | 8/1992 | Parris | |
| 5,191,954 | A | 3/1993 | Ledford | |
| 5,461,752 | A | 10/1995 | Lemon | |
| 5,493,751 | A | 2/1996 | Misiukowiec | |
| 5,503,245 | A | 4/1996 | Etesam | |
| 5,507,363 | A | 4/1996 | Tredup | |
| 5,636,817 | A | 6/1997 | Beachy | |
| 6,019,241 | A * | 2/2000 | Burns | B44D 3/126 15/257.06 |
| 6,148,958 | A | 11/2000 | Ahl | |
| 2009/0277913 | A1 * | 11/2009 | Bergman | B44D 3/126 220/570 |

* cited by examiner

*Primary Examiner* — Alvin Chin-Shue

(74) *Attorney, Agent, or Firm* — David A. Belasco; Belasco Jacobs & Townsley, LLP

(57) ABSTRACT

A paint roller tray mounting device includes a platform with a width sized to fit between first and second side rung supports of a ladder or step ladder, a length to support a paint roller tray with at least two tabs located at upper edges of the tray. The tabs have mounting holes in them. The platform has a recess in an upper surface sized and shaped to provide a gripping surface for a ladder rung. At least two bolts are symmetrically attached through opposite edges of the platform. The bolts extend from a lower surface of the platform through the mounting holes in the tabs at the upper edge of the paint roller tray. The bolts are tightened, urging the tray and the platform together. The platform is located beneath and the paint roller tray is located above the ladder rung or a top shelf of a step ladder.

6 Claims, 6 Drawing Sheets

PAINT ROLLER TRAY MOUNTING DEVICE

RELATED APPLICATION

This application is a divisional application of U.S. application Ser. No. 14/677,723, filed Apr. 2, 2015 and currently pending which is a continuation-in-part of U.S. application Ser. No. 12/774,691, filed May 5, 2010, currently abandoned and incorporates the contents of both in their entirety.

FIELD OF INVENTION

This invention relates to the field of painting aids, and more specifically to a device for mounting a paint roller tray to a ladder.

BACKGROUND OF THE INVENTION

Paint rollers offer an easy and efficient way to pain flat surfaces. The roller eliminates brush marks and provides a smoothly finished surface for even the relatively unskilled painter. Paint rollers are typically charged with paint using a roller tray. This shallow rectangular tray usually has a sloped bottom surface with some ridges formed in it to help distribute the paint evenly over the roller. Painting with a roller and roller tray can become more difficult if it becomes necessary for the painter to stand on a ladder while painting. This often occurs when painting ceilings or higher portions of walls. When the painter must stand on a ladder, the positioning of the roller tray can be problematical. What is desired is a way to secure the roller tray to a ladder or step ladder in such a way that it can be easily removed and attached to facilitate filling and cleaning of the tray. Various inventions have been developed to address this problem.

U.S. Pat. No. 3,822,846, issued to Jesionowski, discloses a combination platform roller pan and tray for a paint roller that has a pair of aligned bosses which extend outwardly from each side thereof, the bosses being releasably engageable with locking means which is releasably associated with the ladder, the locking means in one form comprising a locking hook engageable with the step or rung of the ladder and, in another form, comprising a locking cam engageable in the rung of the ladder.

U.S. Pat. No. 4,424,949, issued to Kimmett, et al. is directed to an adjustable paint tray support for use on a ladder having a bracket for attaching to one of the legs of the ladder is disclosed. The bracket contains a section for engaging one of the steps or rungs on the ladder. A support member for the paint tray is pivotally connected to the bracket. The support member has a raised portion at each end for engaging the paint tray. A clamp is positioned on the bracket to engage a portion of the support member to releasably secure the support member with respect to the bracket.

U.S. Pat. No. 4,489,911, issued to Riley illustrates a device capable of being mounted on a ladder having hollow rungs comprises a platform or tray having a first arm mounted thereon adjacent one end thereof and a second arm pivotably mounted thereon adjacent the other end thereof and extending below the platform or tray, said second arm being adjustable in length and said arms being adapted to enter the hollow rungs of a ladder. In use the first and second arms are inserted in separate rungs of the ladder, the second arm being inserted in the rung below the first arm.

U.S. Pat. No. 5,135,193, issued to Parris disclose a tray that attaches to the side of hollow-rung ladders. The tray is sized large enough to accommodate an industry standard paint-roller-pan and hold it in a convenient position for the user either at the left side or at the right side of the ladder. The tray mounts to the ladder via a shaft that passes thru one hollow-rung. Secure attachment to various width ladders is accomplished via a safety-clip inserted into one of the series of thru-holes in the free end of the shaft that extends thru the hollow-rung. Adjustment of the tray to horizontal is accomplished via a movable L-shaped support that penetrates into a second hollow-rung. This invention contains fewer and simpler parts in comparison to prior inventions.

U.S. Pat. No. 5,461,752, issued to Lemon, et al. is directed to a ladder-upright-mountable, paint tray assembly is provided wherein at least one bracket assembly is provided on the underside of upper, paint draining portion of the paint tray assembly. Therefore each bracket assembly is a sliding fit on the ladder upright and hooks over a portion of a ladder rung adjacent that upright. A central bracket assembly may be provided alone or in combination with two side bracket assemblies. In other embodiments only two side brackets are provided. Pairs of paint container wall members may also be provided, aligned with the bracket assemblies, for the ladder upright to be slidably retained therein.

U.S. Pat. No. 5,493,751, issued to Misiukowiec, et al. discloses a versatile paint pan has a receptacle and a bracket removably attached to the back of the receptacle. The bracket has a base and two legs. The bracket may be pivoted to dispose the paint pan on a horizontal surface. The bracket may be supported transversely on a step of a ladder such that the receptacle is suspended vertically externally of the side rail of the ladder. The bracket may also be supported substantially parallel to a step of the ladder and such that the receptacle is suspended vertically between the side rails of the ladder. The paint pan has a paint brush holder and a removable cover.

U.S. Pat. No. 5,503,245, issued to Etesam discloses a step ladder that includes legs and a ladder top connected to the ladder legs. The ladder top is molded integrally from a polymer material and has an inverted-cup shape defined by a generally rectangular central web with a periphery and peripheral flanges extending generally down from the periphery. The web defines a platform of the ladder top on which articles such as tools and paint cans can be placed. The web has a pair of eye-loops protruding up from a plane common with the platform, these eye loops being spaced and arranged for removably receiving a pair of hooks on a conventional roller paint-pan so as to support the paint-pan on the top surface of the platform.

U.S. Pat. No. 5,507,363, issued to Tredup discloses a universal portable support platform for a ladder base is formed from a plurality of interfitting elements capable of left and right interconnections so that a horizontal support can be located selectively adjacent an elevated work site. Adjustment means are provided to level the horizontal support, regardless of the angulation of the ladder base.

U.S. Pat. No. 6,148,958, issued to Ahl, et al. discloses a ladder supported holding tray assembly for releasable attachment to a ladder includes a generally horizontal container including opposing side panels, a front, a back, and a bottom. The tray assembly also includes a ladder attachment bracket including a connecting wall attaching the bracket to a side panel of the tray. Step engagement means are disposed on the bracket, wherein the step engagement means comprises an upward sloping surface to releasably engage and securely hook onto a step from underneath the step. The tray when mounted on a ladder extends laterally outwardly from the ladder so as to not interfere with the normal use of the ladder.

It is an objective of the present invention to provide a device for removably attaching a paint roller tray to either a ladder or a step ladder. It is a further objective to provide such a device that is easily removed and reattached for purposes of filling or cleaning. It is a still further objective of the invention to provide a device that is easily adaptable to a variety of paint roller trays. It is yet a further objective to provide a device that can maintain a level orientation at all times. Finally, it is an objective of the present invention to provide such a device that is durable, inexpensive and easily manufactured.

While some of the objectives of the present invention are disclosed in the prior art, none of the inventions found include all of the requirements identified.

SUMMARY OF THE INVENTION

The present invention addresses all of the deficiencies of prior art paint roller tray mounting device inventions and satisfies all of the objectives described above.

(1) A paint roller tray mounting device providing all of the desired features can be constructed from the following components. A paint roller tray is provided. The paint roller tray has a paint reservoir at a first end and an inclined surface beginning at an opposite second end. The inclined surface extends downwardly to the paint reservoir. First and second side walls are located adjacent the inclined surface. A surrounding upper edge is provided. The edge surrounds the reservoir and the inclined surface. A platform is provided. The platform has a width sized to fit between first and second side rung supports of a ladder, a length sufficient to support the paint roller tray and has a recess in an upper surface. The recess is sized and shaped to provide a gripping surface for a ladder rung.

At least two securing hooks are provided. The hooks have a hooking end and an attaching end and are symmetrically attached at the attaching end adjacent opposite edges of the platform. The securing hooks are sized and shaped to extend from at least a lower surface of the platform to the surrounding upper edge of the paint roller tray. The hooks have a tightening device for urging the paint roller tray and the platform together. The platform is located beneath either the ladder rung or a top shelf of a step ladder. The paint roller tray is located above either the rung or the top shelf. The securing hooks are located over the surrounding upper edge, the tightening device is tightened and the paint roller tray is secured to either the rung or the shelf with the paint roller tray providing an upper gripping surface for either of the ladder rung and a top shelf of the step ladder. The paint roller tray is a structural element of the mounting device.

(2) In a variant of the invention, the attaching end further includes a threaded shaft. The threaded shaft begins at the attaching end and extends upwardly for a first extended distance. A mating nut is provided. The mating nut has internal threads to fit the threaded shaft. The threaded shaft is passed slidably through an aperture adjacent an edge of the platform and the mating nut is threaded onto the threaded shaft.

(3) In another variant, the nut further includes attached levers, the levers extend radially from a central axis of the nut to assist in hand tightening.

(4) In still another variant, the nut is a wingnut.

(5) In yet another variant, each of the securing hooks further includes an upper portion. The upper portion includes the hooking end. A lower portion is provided. The lower portion includes the attaching end. A cam lock mechanism is provided. The mechanism joins the upper portion and the lower portion and has an attached activating lever. The lever moves the mechanism from a first, extended position, to a second contracted position. Moving the activating lever from the first position to the second position shortens the securing hook and causes the paint roller tray to bear against a top surface of either the rung or the shelf and the platform to bear against a bottom surface of either the rung or the shelf, thereby securing the paint roller tray to the ladder.

(6) In a further variant, each of the securing hooks further includes an upper portion. The upper portion extends from the hooking end to a vertical shaft to a flattened pin supporting plate. The plate has a cylindrical pin located orthogonally to the plate. A lower portion is provided. The lower portion has a flattened upper end, a pivot pin orthogonally mounted to the flattened upper end and a threaded shaft. The threaded shaft begins at the attaching end and extends upwardly for a first predetermined distance. A mating locknut is provided. The locknut is attached to the threaded shaft after the shaft is inserted through an aperture adjacent an edge of the platform.

A cam plate is provided. The cam plate has a central aperture. The aperture is sized to fit slidably about the pivot pin and has a curved, eccentric slot. The slot is sized to fit closely about the cylindrical pin. A cam handle is provided. The handle is attached to a side edge of the cam plate and rotates the cam plate about the pivot pin from a first, open position, moving the cylindrical pin upwardly, to a second closed position, moving the cylindrical pin downwardly. Moving the cam handle from the first position to the second position shortens the securing hook and causes the paint roller tray to bear against a top surface of either the rung or the shelf and the platform to bear against a bottom surface of either the rung or the shelf, thereby securing the paint roller tray to the ladder.

(7) In still a further variant, the platform further includes a tool tray. The tool tray is located along an edge orthogonal to the length and provides any of holders, apertures and brackets for painting tools.

(8) In yet a further variant, a paint roller tray mounting device, includes a platform. The platform has a width sized to fit between first and second side rung supports of a ladder or step ladder, a length sufficient to support a paint roller tray and has a recess in an upper surface. The recess is sized and shaped to provide a gripping surface for a ladder rung. A paint roller tray is provided. The tray consists of an inclined bottom surface and front, rear, left side and right side surrounding walls. The walls have upper edges and at least two tabs mounted to the front and rear walls. Each of the tabs has a hole through it. At least two fasteners are provided. The fasteners are adapted to attach the tabs to the platform. The platform is located beneath either a ladder rung or a top shelf of the step ladder. The paint roller tray is located above and directly grips either the rung or the shelf. The fasteners are deployed to urge the tabs and the platform toward each other and the paint roller tray is secured to either the rung or the shelf.

(9) In another variant of the invention, each of the fasteners includes a bolt and mating nut.

(10) In still another variant, the mating nut is a wingnut.

(11) In yet another variant, a method of mounting a paint roller tray to a ladder, includes the steps of:

providing a paint roller tray. The paint roller tray has a paint reservoir at a first end and an inclined surface beginning at an opposite second end. The inclined surface extends downwardly to the paint reservoir. First and second side walls are located adjacent the inclined surface. Providing a surrounding upper edge. The edge surrounds the reservoir and the inclined surface.

providing a platform that has a width sized to fit between first and second side rung supports of a ladder, a length sufficient to support the paint roller tray and has a recess in an upper surface. The recess is sized and shaped to provide a gripping surface for a ladder rung.

providing at least two securing hooks that have a hooking end and an attaching end and are symmetrically attached at the attaching end adjacent opposite edges of the platform.

the securing hooks are sized and shaped to extend from at least a lower surface of the platform to the surrounding upper edge of the paint roller tray;

providing a tightening device for the hooks for urging the paint roller tray and the platform together; and locating the platform beneath either the ladder rung or a top shelf of a step ladder;

locating the paint roller tray above either of the rung and the top shelf;

locating the securing hooks over the surrounding upper edge;

tightening the tightening device and thereby securing the paint roller tray to either of the rung and the shelf with the paint roller tray providing an upper gripping surface for either of the ladder rung and the top shelf of a step ladder. The paint roller tray is a structural element of the mounting device.

(12) In a further variant of the invention the method of mounting a paint roller tray to a ladder includes the further steps of:

providing the attaching end with:

a threaded shaft, the threaded shaft begins at the attaching end and extends upwardly for a first extended distance;

a mating nut, the mating nut has internal threads to fit the threaded shaft; and passing the threaded shaft slidably through an aperture adjacent an edge of the platform; and threading the mating nut onto the threaded shaft.

(13) In yet a further variant, the method of mounting a paint roller tray to a ladder includes the further step of providing the mating nut with attached levers, the levers extend radially from a central axis of the nut to assist in hand tightening.

(14) In still a further variant, the method of mounting a paint roller tray to a ladder includes the further step of providing a wingnut as the mating nut.

(15) In yet a further variant, the method of mounting a paint roller tray to a ladder includes the further steps of:

providing the securing hooks that further include:

an upper portion, the upper portion includes the hooking end;

a lower portion, the lower portion includes the attaching end;

a cam lock mechanism, the mechanism joins the upper portion and the lower portion and has an attached activating lever, the lever moves the mechanism from a first, extended position, to a second contracted position; and moving the activating lever from the first position to the second position, shortens the securing hook and causes the paint roller tray to bear against a top surface of either the rung or the shelf and the platform to bear against a bottom surface of either the rung or the shelf, thereby securing the paint roller tray to the ladder.

(16) In another variant of the invention, the method of mounting a paint roller tray to a ladder includes the further steps of:

providing the securing hooks that further comprise:

an upper portion, the upper portion extends from the hooking end to a vertical shaft to a flattened pin supporting plate, the plate has a cylindrical pin located orthogonally to the plate;

a lower portion, the lower portion has a flattened upper end, a pivot pin orthogonally mounted to the flattened upper end and a threaded shaft, the threaded shaft begins at the attaching end and extending upwardly for a first predetermined distance;

providing a mating locknut, the locknut is attached to the threaded shaft after the shaft is inserted through an aperture adjacent an edge of the platform;

providing a cam plate, the cam plate has a central aperture, the aperture is sized to fit slidably about the pivot pin and has a curved, eccentric slot, the slot is sized to fit closely about the cylindrical pin;

providing a cam handle, the handle is attached to a side edge of the cam plate and rotates the cam plate about the pivot pin from a first, open position, moving the cylindrical pin upwardly, to a second closed position, moving the cylindrical pin downwardly;

moving the cam handle from the first position to the second position shortens the securing hook and causes the paint roller tray to bear against a top surface of either the rung or the shelf and the platform to bear against a bottom surface of either the rung or the shelf, thereby securing the paint roller tray to the ladder.

(17) In still another variant, the method of mounting a paint roller tray to a ladder includes the further step of providing a tool tray, the tool tray is located adjacent the platform along an edge orthogonal to the length and providing any of holders apertures and brackets for painting tools.

(18) In yet another variant, a method of mounting a paint roller tray to a ladder or a step ladder, includes the steps of:

providing a platform, the platform has a width sized to fit between first and second side rung supports of a ladder or a step ladder, a length sufficient to support a paint roller tray and has a recess in an upper surface, the recess is sized and shaped to provide a gripping surface for a ladder rung;

providing a paint roller tray, the tray consists of an inclined bottom surface, front, rear, left side and right side surrounding walls, the walls has upper edges and at least two tabs mounted to the front and rear walls, each of the tabs has a hole through it;

providing at least two fasteners, the fasteners are adapted to attach the tabs to the platform; and locating the platform beneath either the ladder rung or a top shelf of the step ladder;

locating the paint roller tray above and directly gripping either the rung or the top shelf;

locating the fasteners to urge the tabs and the platform toward each other, with said bottom surface of said paint roller tray functioning as a mating structural element for said platform, thereby securing the paint roller tray to either the rung or the top shelf

(19) In still another variant, the method of mounting a paint roller tray to a ladder or step ladder, includes the further step of providing a bolt and mating nut as the fasteners.

(20) In a final variant of the invention, the method of mounting a paint roller tray to a ladder or step ladder, includes the additional step of providing a wingnut as the mating nut.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1-8 illustrate a paint roller tray mounting device 10 providing all of the desired features can be constructed from the following components. As illustrated in FIGS. 1-3, a paint roller tray 38 and a platform 14 are provided. The paint roller tray 38 has a paint reservoir 40 at a first end 44 and an inclined surface 48 beginning at an opposite second end 52. The inclined surface 48 extends downwardly to the paint reservoir 40. First 56 and second 60 side walls are located adjacent the inclined surface 48. A surrounding upper edge 82 is provided. The edge 82 surrounds the reservoir 40 and the inclined surface 48. The platform 14 has a width 18 sized to fit between first 22 and second 26 side rung supports of a ladder 30, a length 34 sufficient to support the paint roller tray 38 and has a recess 42 in an upper surface 46. The recess 42 is sized and shaped to provide a gripping surface 50 for a ladder rung 54.

Figure 1:
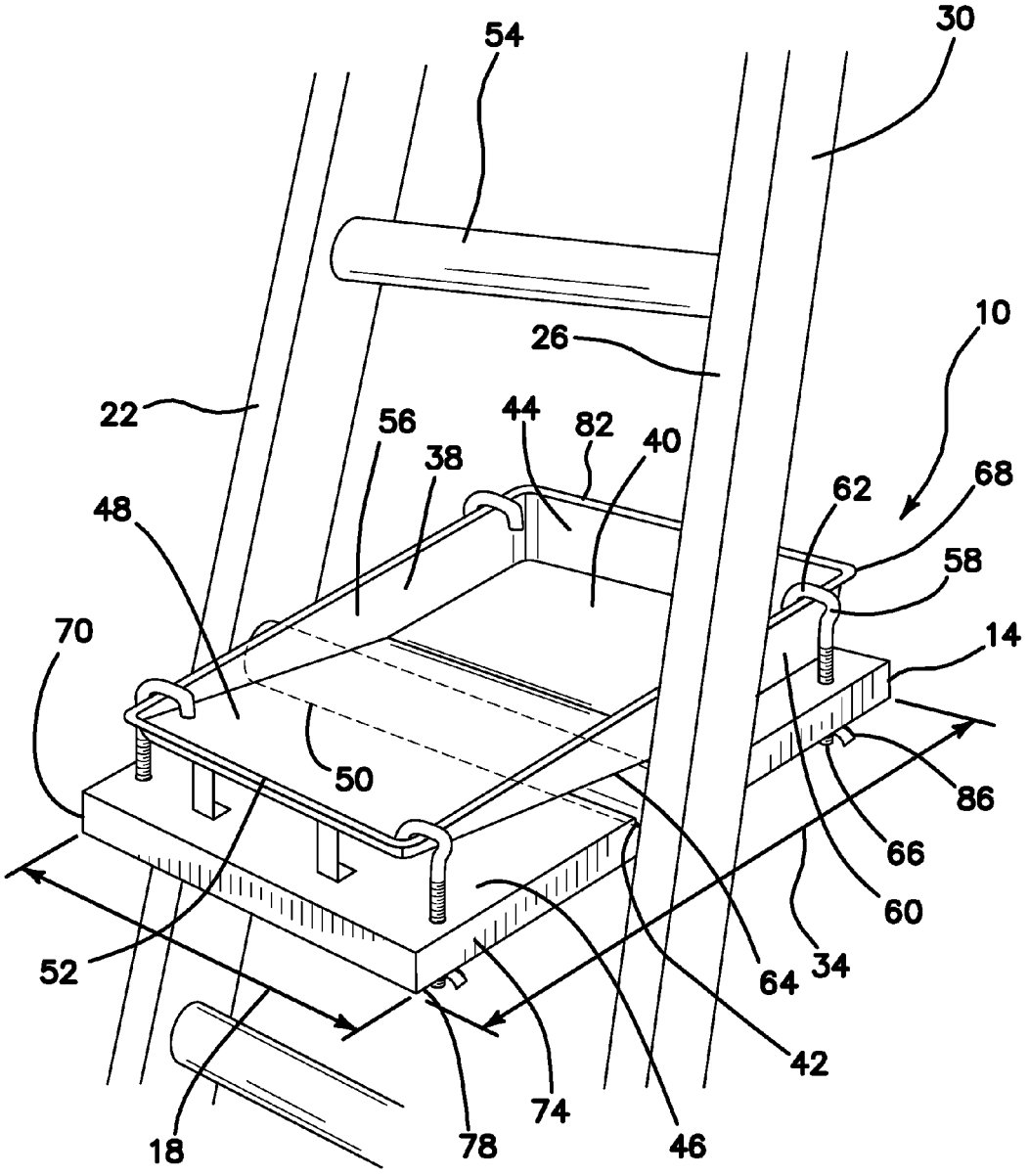
FIG. 1 is a perspective view of the preferred embodiment of the invention illustrating securing hooks holding a paint roller tray to a platform fastened about a ladder rung.

At least two securing hooks 58 are provided. The hooks 58 have a hooking end 62 and an attaching end 66 and are symmetrically attached at the attaching end 66 adjacent opposite edges 70, 74 of the platform 14. The securing hooks 58 are sized and shaped to extend from at least a lower surface 78 of the platform 14 to the surrounding upper edge 82 of the paint roller tray 38. The hooks 58 have a tightening device 86 for urging the paint roller tray 38 and the platform 14 together. The platform 14 is located beneath either the ladder rung 54 or a top shelf 90 of a step ladder 94. The paint roller tray 38 is located above either the rung 54 or the top shelf 90. The securing hooks 58 are located over the surrounding upper edge 82, the tightening device 86 is tightened and the paint roller tray 38 is secured to either the rung 54 or the shelf 90 with the paint roller tray 38 providing an upper gripping surface 64 for either of the ladder rung 54 and the top shelf 90 of the step ladder. The paint roller tray 38 is a structural element 68 of the mounting device 10.

Figure 3:
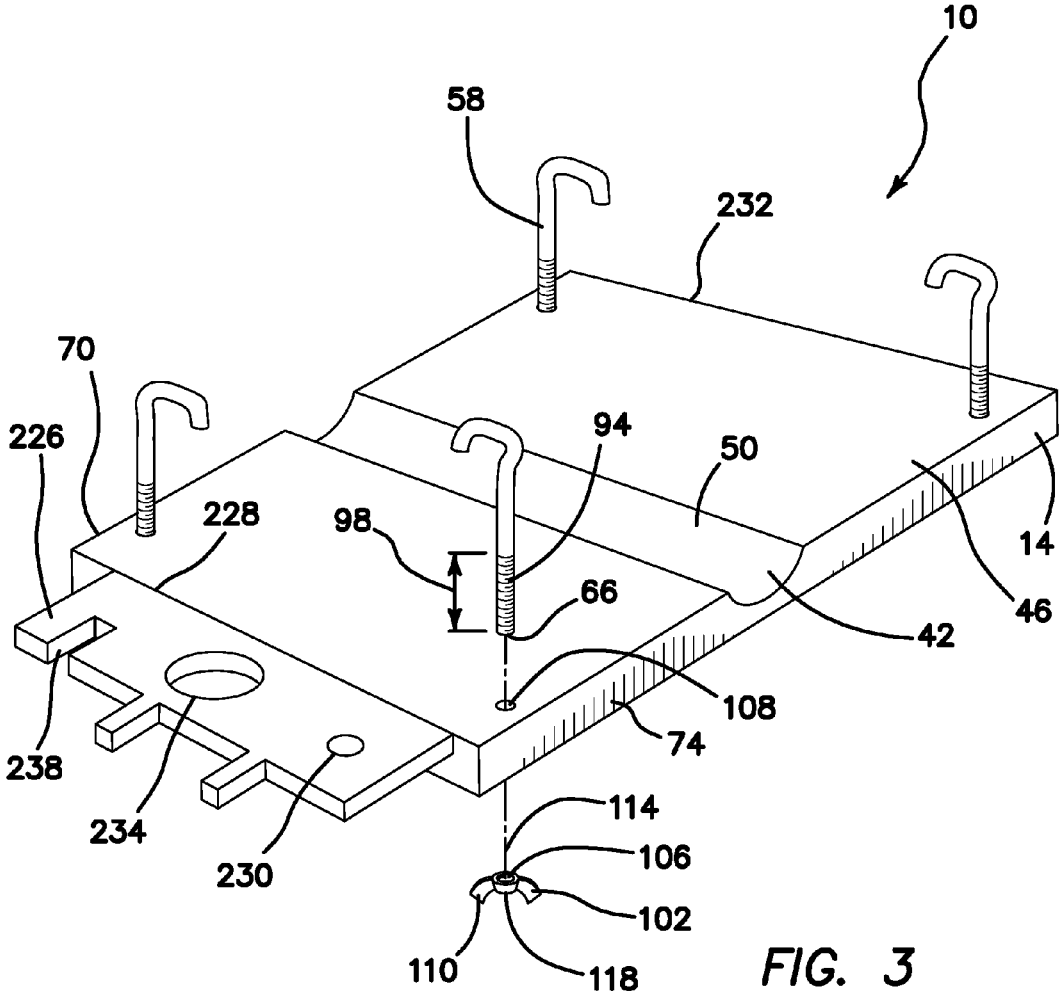
FIG. 3 is a perspective view of the platform and securing hooks of the FIG. 1 embodiment illustrating a tool tray.

(2) In a variant of the invention, as illustrated in FIG. 3, the attaching end 66 further includes a threaded shaft 94. The threaded shaft 94 begins at the attaching end 66 and extends upwardly for a first extended distance 98. A mating nut 102 is provided. The mating nut 102 has internal threads 106 to fit the threaded shaft 94. The threaded shaft 94 is passed slidably through an aperture 108 adjacent an edge 70, 74 of the platform 14 and the mating nut 102 is threaded onto the threaded shaft 94.

(3) In another variant, the nut 102 further includes attached levers 110, the levers 110 extend radially from a central axis 114 of the nut 102 to assist in hand tightening.

(4) In still another variant, the nut 102 is a wingnut 118.

Figure 5:
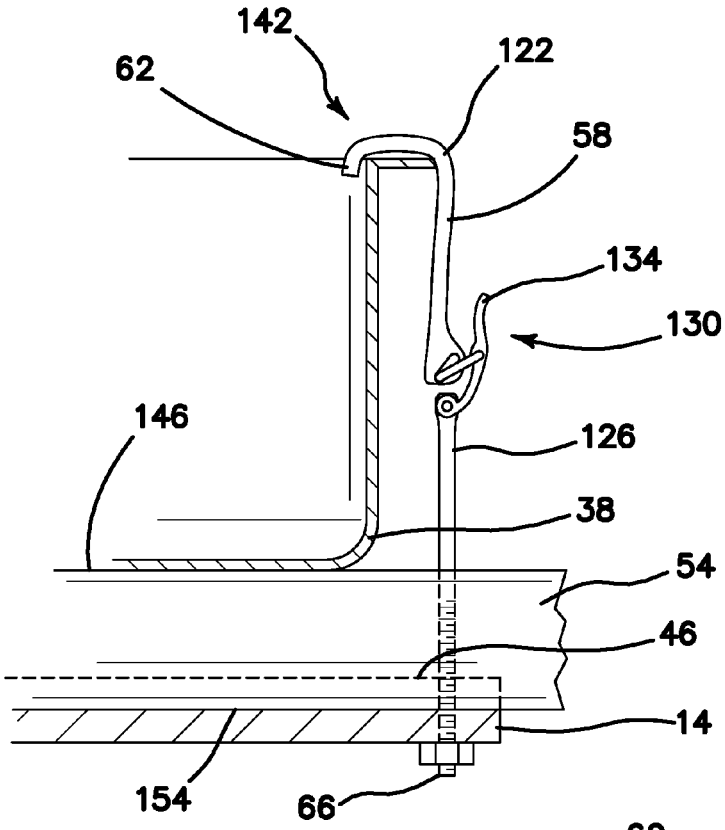
FIG. 5 is a side elevational view of an alternative embodiment of the securing hook of the FIG. 1 embodiment illustrating a cam-lock device in a closed position.
Figure 6:
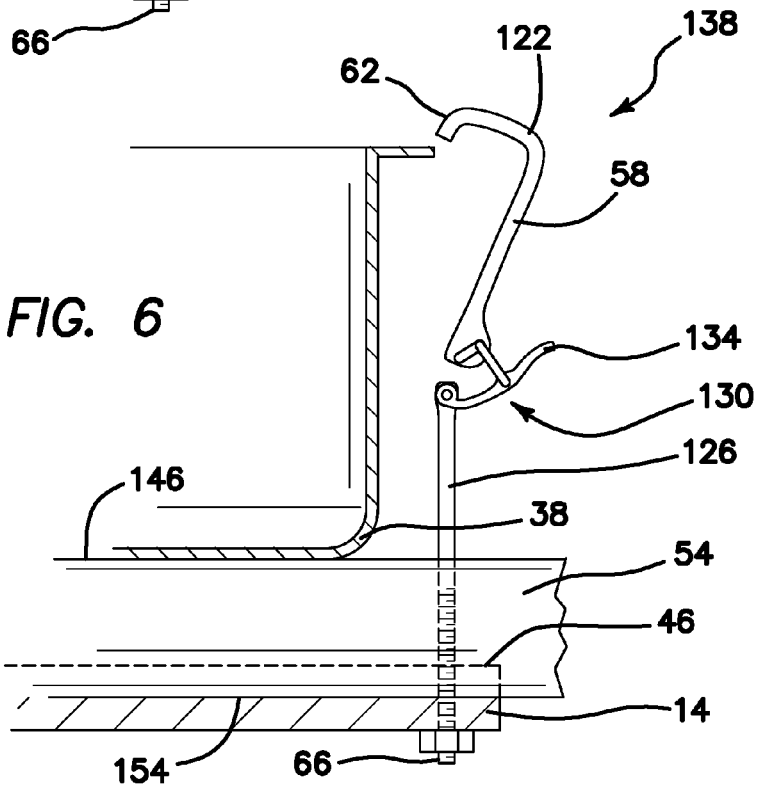
FIG. 6 is a side elevational view of the FIG. 5 embodiment of the securing hook illustrating a cam-lock device in an open position.

(5) In yet another variant, as illustrated in FIGS. 5 and 6, each of the securing hooks 58 further includes an upper portion 122. The upper portion 122 includes the hooking end 62. A lower portion 126 is provided. The lower portion 126 includes the attaching end 66. A cam lock mechanism 130 is provided. The mechanism 130 joins the upper portion 122 and the lower portion 126 and has an attached activating lever 134. The lever 134 moves the mechanism 130 from a first, extended position 138, to a second contracted position 142. Moving the activating lever 134 from the first position 138 to the second position 142 shortens the securing hook 58 and causes the paint roller tray 38 to bear against a top surface 146, 150 of either the rung 54 or the shelf 90 and the platform 14 to bear against a bottom surface 154, 158 of either the rung 54 or the shelf 90, thereby securing the paint roller tray 38 to the ladder 30.

Figure 7:
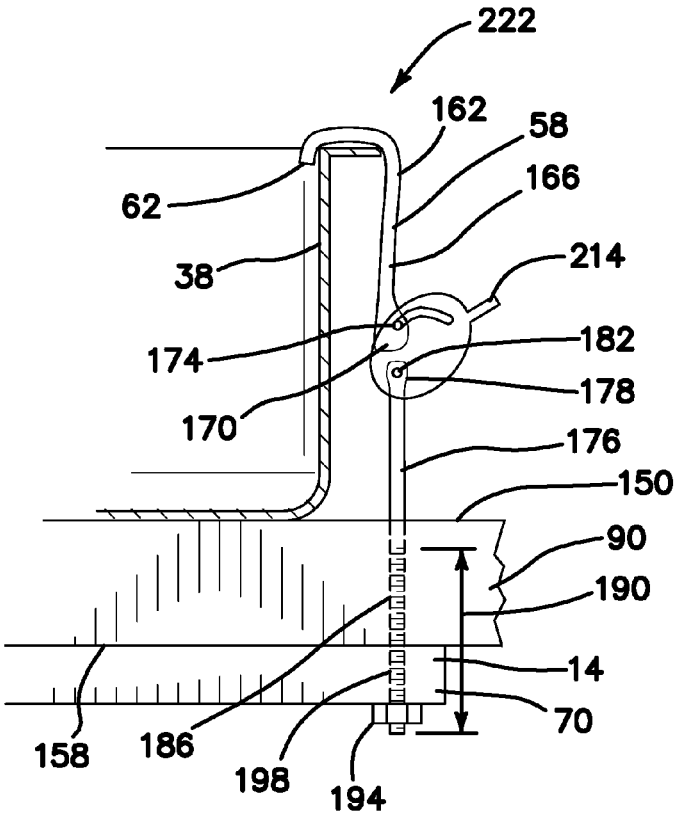
FIG. 7 is a side elevational view of a second alternative embodiment of the securing hook of the FIG. 1 embodiment illustrating a cam-lock device in a closed position.
Figure 8:
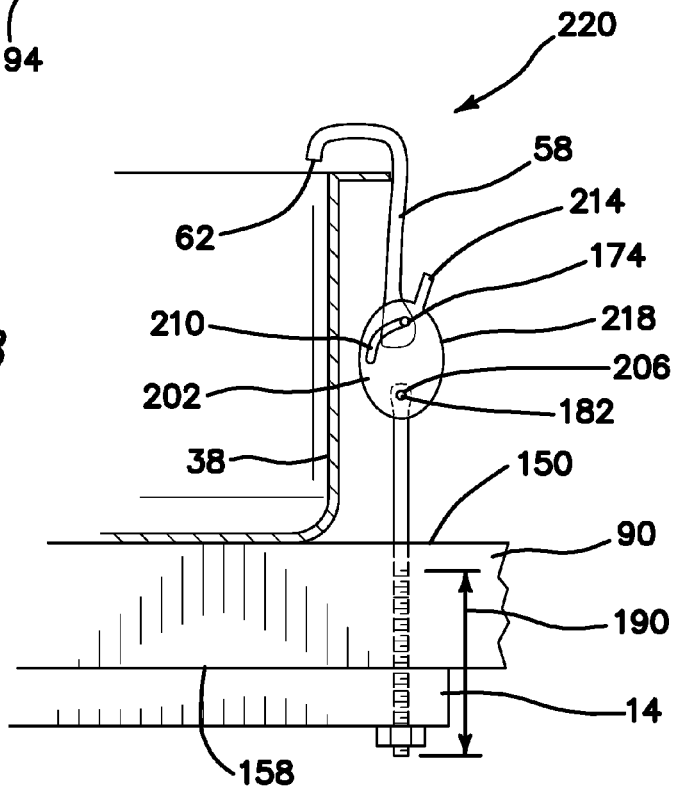
FIG. 8 is a side elevational view of a second alternative embodiment of the securing hook illustrating a cam-lock device in an open position.

(6) In a further variant, as illustrated in FIGS. 7 and 8, each of the securing hooks 58 further includes an upper portion 162. The upper portion 162 extends from the hooking end 62 to a vertical shaft 166 to a flattened pin supporting plate 170. The plate 170 has a cylindrical pin 174 located orthogonally to the plate 170. A lower portion 176 is provided. The lower portion 176 has a flattened upper end 178, a pivot pin 182 orthogonally mounted to the flattened upper end 178 and a threaded shaft 186. The threaded shaft 186 begins at the attaching end 66 and extends upwardly for a first predetermined distance 190. A mating locknut 194 is provided. The locknut 194 is attached to the threaded shaft 186 after the shaft 186 is inserted through an aperture 198 adjacent an edge 70, 74 of the platform 14.

A cam plate 202 is provided. The cam plate 202 has a central aperture 206. The aperture 206 is sized to fit slidably about the pivot pin 182 and has a curved, eccentric slot 210. The slot 210 is sized to fit closely about the cylindrical pin 174. A cam handle 214 is provided. The handle 214 is attached to a side edge 218 of the cam plate 202 and rotates the cam plate 202 about the pivot pin 182 from a first, open position 218, moving the cylindrical pin 174 upwardly, to a second closed position 222, moving the cylindrical pin 174 downwardly. Moving the cam handle 214 from the first position 218 to the second position 222 shortens the securing hook 58 and causes the paint roller tray 38 to bear against a top surface 146, 150 of either the rung 54 or the shelf 90 and the platform 14 to bear against a bottom surface 154, 158 of either the rung 54 or the shelf 90, thereby securing the paint roller tray 38 to the ladder 30.

(7) In still a further variant, as illustrated in FIG. 3, the platform 14 further includes a tool tray 226. The tool tray 226 is located along an edge 228, 232 orthogonal to the length 34 and provides any of holders 230, apertures 234 and brackets 238 for painting tools (not shown).

Figure 4:
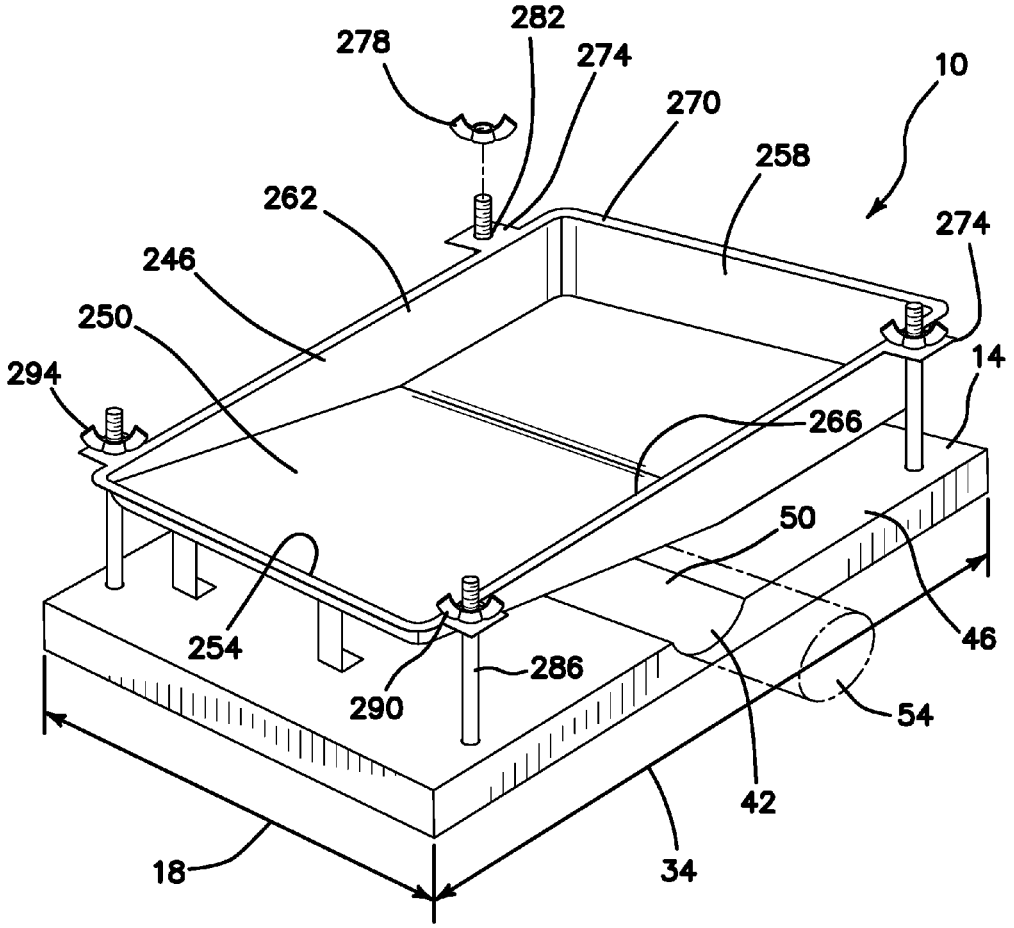
FIG. 4 is a perspective view of the of an alternative embodiment illustrating attaching tabs on the sides of the paint roller tray.

(8) In yet a further variant, as illustrated in FIG. 4, a paint roller tray mounting device 10, includes a platform 14. The platform 14 has a width 18 sized to fit between first 22 and second 26 side rung supports of a ladder 30 or step ladder 94, a length 34 sufficient to support a paint roller tray 246 and has a recess 42 in an upper surface 46. The recess 42 is sized and shaped to provide a gripping surface 50 for a ladder rung 54. A paint roller tray 246 is provided. The tray 246 consists of an inclined bottom surface 250 and front 254, rear 258, left side 262 and right side 266 surrounding walls. The walls 254, 258, 262, 266 have upper edges 270 and at least two tabs 274 mounted to the front 254 and rear 258 walls. Each of the tabs 274 has a hole 278 through it. At least two fasteners 282 are provided. The fasteners 282 are adapted to attach the tabs 274 to the platform 14. The platform 14 is located beneath either a ladder rung 54 or a top shelf 90 of a step ladder 94. The paint roller tray 246 is located above and directly grips either the rung 54 or the shelf 90. The fasteners 282 are deployed to urge the tabs 274 and the platform 14 toward each other and the paint roller tray 246 is secured to either the rung 54 or the shelf 90.

(9) In another variant of the invention, each of the fasteners 282 includes a bolt 286 and mating nut 290.

(10) In still another variant, the mating nut 290 is a wingnut 294.

Figure 2:
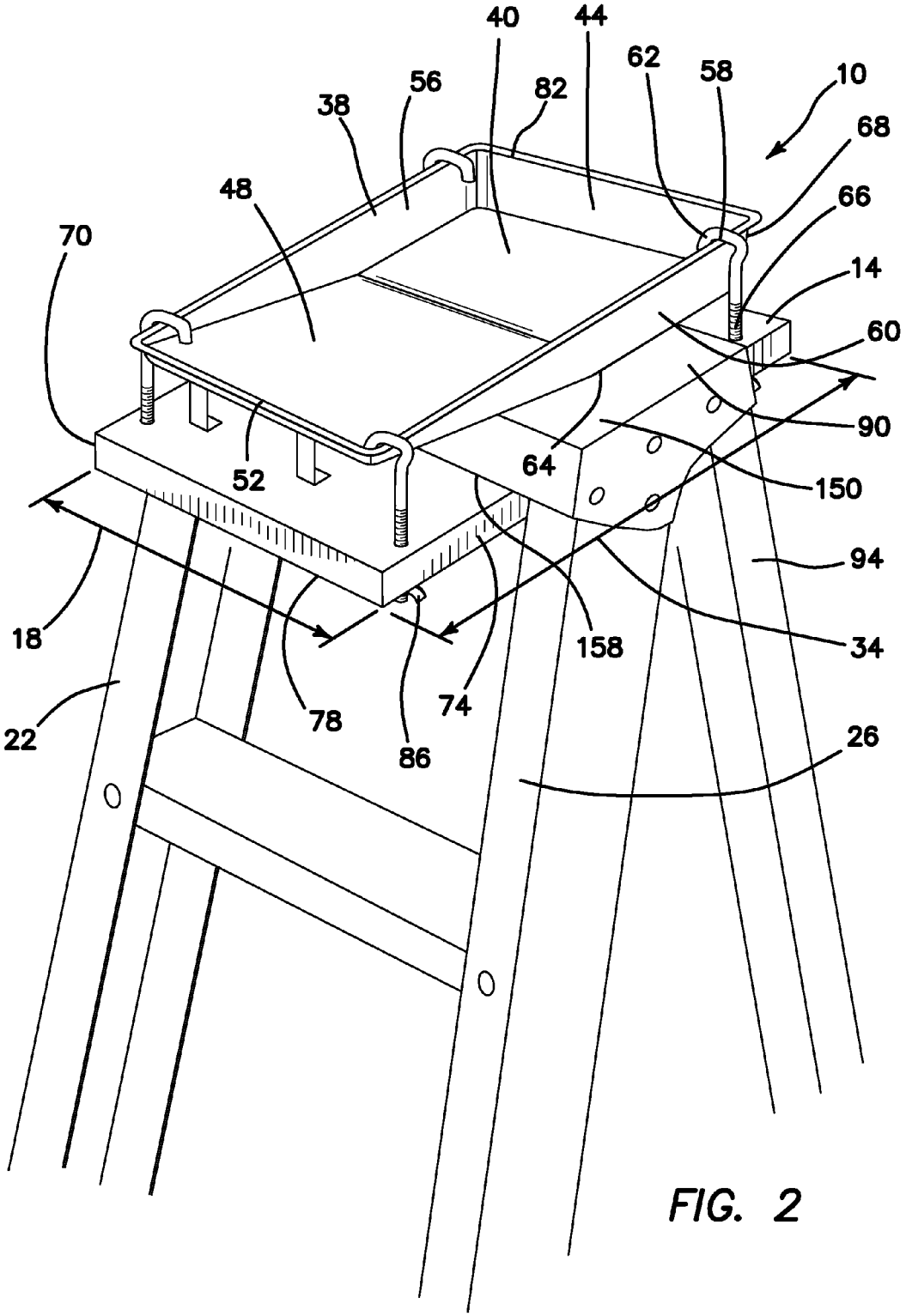
FIG. 2 is a perspective view of the of the FIG. 1 embodiment attached to a step ladder.

(11) In yet another variant, as illustrated in FIGS. 1 and 2, a method of mounting a paint roller tray 38 to a ladder 30, includes the steps of:

providing a paint roller tray 38. The paint roller tray 38 has a paint reservoir 40 at a first end 44 and an inclined surface 48 beginning at an opposite second end 52. The inclined surface 48 extends downwardly to the paint reservoir 40. First 56 and second 60 side walls are located adjacent the inclined surface 48. Providing a surrounding upper edge 82. The edge 82 surrounds the reservoir 40 and the inclined surface 48.

providing a platform 14 that has a width 18 sized to fit between first 22 and second 26 side rung supports of a ladder 30, a length 34 sufficient to support the paint roller tray 38 and has a recess 42 in an upper surface 46. The recess 46 is sized and shaped to provide a gripping surface 50 for a ladder rung 54.

providing at least two securing hooks 58 that have a hooking end 62 and an attaching end 66 and are symmetrically attached at the attaching end 66 adjacent opposite edges 70,74 of the platform 14.

the securing hooks 58 are sized and shaped to extend from at least a lower surface 78 of the platform 14 to the surrounding upper edge 82 of the paint roller tray 38;

providing a tightening device 86 for the hooks 58 for urging the paint roller tray 38 and the platform 14 together; and locating the platform 14 beneath either the ladder rung 54 or a top shelf 90 of a step ladder 94;

locating the paint roller tray 38 above either of the rung 54 and the top shelf 90;

locating the securing hooks 58 over the surrounding upper edge 82;

tightening the tightening device 86 and thereby securing the paint roller tray 38 to either of the rung 54 and the shelf 90 with the paint roller tray 38 providing an upper gripping surface 64 for either of the ladder rung 54 and the top shelf 90 of the step ladder. The paint roller tray 38 is a structural element 68 of the mounting device 10.

(12) In a further variant of the invention, as illustrated in FIG. 3, the method of mounting a paint roller tray 38 to a ladder 30 includes the further steps of:

providing the attaching end 66 with:

a threaded shaft 94, the threaded shaft 94 begins at the attaching end 66 and extends upwardly for a first extended distance 98;

a mating nut 102, the mating nut 102 has internal threads 106 to fit the threaded shaft 94; and passing the threaded shaft 94 slidably through an aperture 108 adjacent an edge 70, 74 of the platform 14; and threading the mating nut 102 onto the threaded shaft 94.

(13) In yet a further variant, the method of mounting a paint roller tray 38 to a ladder 30 includes the further step of providing the mating nut 102 with attached levers 110, the levers 110 extend radially from a central axis 114 of the nut 102 to assist in hand tightening.

(14) In still a further variant, the method of mounting a paint roller tray 38 to a ladder 30 includes the further step of providing a wingnut 118 as the mating nut 102.

(15) In yet a further variant, as illustrated in FIGS. 5 and 6, the method of mounting a paint roller tray 38 to a ladder 30 includes the further steps of:

providing the securing hooks 58 that further include:

an upper portion 122, the upper portion 122 includes the hooking end 62;

a lower portion 126, the lower portion 126 includes the attaching end 66;

a cam lock mechanism 130, the mechanism 130 joins the upper portion 122 and the lower portion 126 and has an attached activating lever 134, the lever 134 moves the mechanism 130 from a first, extended position 138, to a second contracted position 142; and moving the activating lever 134 from the first position 138 to the second position 142, shortens the securing hook 58 and causes the paint roller tray 38 to bear against a top surface 146, 150 of either the rung or the shelf 90 and the platform 14 to bear against a bottom surface 154, 158 of either the rung 54 or the shelf 90, thereby securing the paint roller tray 38 to the ladder 30.

16) In another variant of the invention, as illustrated in FIGS. 6 and 7, the method of mounting a paint roller tray 38 to a ladder 30 includes the further steps of:

providing the securing hooks 58 that further comprise:

an upper portion 162, the upper portion 162 extends from the hooking end 62 to a vertical shaft 166 to a flattened pin supporting plate 170, the plate 170 has a cylindrical pin 174 located orthogonally to the plate 170;

a lower portion 176, the lower portion 176 has a flattened upper end 178, a pivot pin 182 orthogonally mounted to the flattened upper end 178 and a threaded shaft 186, the threaded shaft 186 begins at the attaching end 66 and extending upwardly for a first predetermined distance 190;

providing a mating locknut 194, the locknut 194 is attached to the threaded shaft 186 after the shaft 186 is inserted through an aperture 198 adjacent an edge 70, 74 of the platform 14;

providing a cam plate 202, the cam plate 202 has a central aperture 206, the aperture 206 is sized to fit slidably about the pivot pin 182 and has a curved, eccentric slot 210, the slot 210 is sized to fit closely about the cylindrical pin 174;

providing a cam handle 214, the handle 214 is attached to a side edge 218 of the cam plate 202 and rotates the cam plate 202 about the pivot pin 182 from a first, open position 218, moving the cylindrical pin 174 upwardly, to a second closed position 222, moving the cylindrical pin 174 downwardly;

moving the cam handle 214 from the first position 218 to the second position 222 shortens the securing hook 58 and causes the paint roller tray 38 to bear against a top surface 146, 150 of either the rung 54 or the shelf 90 and the platform 14 to bear against a bottom surface 154, 158 of either the rung 54 or the shelf 90, thereby securing the paint roller tray 38 to the ladder 30.

(17) In still another variant, as illustrated in FIG. 3, the method of mounting a paint roller tray 38 to a ladder 30 includes the further step of providing a tool tray 226, the tool tray 226 is located adjacent the platform 14 along an edge 70, 74 orthogonal to the length 34 and providing any of holders 230 apertures 234 and brackets 238 for painting tools 242 (not shown).

(18) In yet another variant, as illustrated in FIG. 4, a method of mounting a paint roller tray 38 to a ladder 30 or a step ladder 94, includes the steps of:

providing a platform 14, the platform has a width 18 sized to fit between first 22 and second 26 side rung supports of a ladder 30 or a step ladder, a length 34 sufficient to support a paint roller tray 38 and has a recess 42 in an upper surface 46, the recess 42 is sized and shaped to provide a gripping surface 50 for a ladder rung 54;

providing a paint roller tray 246, the tray 246 consists of an inclined bottom surface 250, front 254, rear 258, left side 262 and right side 266 surrounding walls, the walls 254, 258, 262, 266 have upper edges 270 and at least two tabs 274 mounted to the front 254 and rear 258 walls, each of the tabs 274 has a hole 278 through it;

providing at least two fasteners 282, the fasteners 282 are adapted to attach the tabs 274 to the platform 14; and locating the platform 14 beneath either a ladder rung 54 or a top shelf 90 of a step ladder 94;

locating the paint roller tray 246 above and directly gripping either the rung 54 or the shelf 90;

locating the fasteners 282 to urge the tabs 274 and the platform 14 toward each other, with said bottom surface of said paint roller tray functioning as a mating structural element for said platform, thereby securing the paint roller tray 38 to either the rung 54 or the shelf 90.

(19) In still another variant, the method of mounting a paint roller tray 38 to a ladder 30 or step ladder 94, includes the further step of providing a bolt 286 and mating nut 290 as the fasteners 282.

(20) In a final variant of the invention, the method of mounting a paint roller tray 38 to a ladder 30 or step ladder 94, includes the additional step of providing a wingnut 294 as the mating nut 290.

The paint roller tray mounting system and method of using same 10 has been described with reference to particular embodiments. Other modifications and enhancements can be made without departing from the spirit and scope of the claims that follow.

The invention claimed is:

1. A paint roller tray mounting device, comprising:

a platform, said platform having a width sized to fit between first and second side rung supports of a ladder or step ladder, a length sufficient to support a paint roller tray and having a recess in an upper surface, said recess being sized and shaped to provide a gripping surface for a rung of the ladder;

a paint roller tray, said tray comprising of an inclined bottom surface, front, rear, left side and right side surrounding walls, said walls having upper edges and at least two tabs mounted to said front and rear walls, each of said tabs having a holes therethrough;

at least two fasteners, said fasteners extending through the holes of said tabs in attaching said tray to said platform; and wherein said platform is disposed beneath either the ladder rung or a top shelf of said step ladder, said inclined bottom surface of said paint roller tray is disposed above and directly grips either said rung or said shelf, said fasteners urging said tabs and said platform toward each other and said paint roller tray is secured to either said rung or said shelf.

2. The paint roller tray mounting device, as described in claim 1, wherein each of said fasteners comprises a bolt and mating nut.

3. The paint roller tray mounting device, as described in claim 2, wherein said mating nut is a wingnut.

4. A method of mounting a paint roller tray to a ladder or a step ladder, comprising the steps of:

providing a platform, said platform having a width sized to fit between first and second side rung supports of a ladder or a step ladder, a length sufficient to support a paint roller tray and having a recess in an upper surface, said recess being sized and shaped to provide a gripping surface for a rung of the ladder;

providing a paint roller tray, said tray comprising of an inclined bottom surface, front, rear, left side and right side surrounding walls, said walls having upper edges and at least two tabs mounted to said front and rear walls, each of said tabs having a holes therethrough;

providing at least two fasteners, said fasteners extending through the holes of said tabs in attaching said tray to said platform; and disposing said platform beneath either said ladder rung or a top shelf of said step ladder;

disposing said inclined bottom surface of said paint roller tray above and directly gripping either said rung or said top shelf;

deploying said fasteners in urging said tabs and said platform toward each other, with said bottom surface of said paint roller tray functioning as a mating structural element for said platform thereby securing said paint roller tray to either said rung or said top shelf.

5. The method of mounting the paint roller tray of claim 4 to the ladder or step ladder, comprising the further step of providing a bolt and mating nut as said fasteners.

6. The method of mounting the paint roller tray of claim 4 to the ladder or step ladder, comprising the additional step of providing a wingnut as said mating nut.

* * * * *